US006817398B2

(12) United States Patent
Huthmacher et al.

(10) Patent No.: US 6,817,398 B2
(45) Date of Patent: Nov. 16, 2004

(54) HAND-HELD DEVICE FOR APPLYING A FILM, FOR EXAMPLE, OF ADHESIVE, COVERING OR COLORED MATERIAL FROM A BACKING TAPE ONTO A SUBSTRATE

(75) Inventors: Winfried Huthmacher, Frankfurt am Main (DE); Roland Schneider, Kelkheim (DE)

(73) Assignee: Societe Bic (FR)

( * ) Notice: Subject to any disclaimer, the term of this patent is extended or adjusted under 35 U.S.C. 154(b) by 0 days.

(21) Appl. No.: 10/751,842

(22) Filed: Jan. 5, 2004

(65) Prior Publication Data

US 2004/0154752 A1 Aug. 12, 2004

Related U.S. Application Data

(63) Continuation of application No. PCT/EP02/06785, filed on Jun. 19, 2002.

(30) Foreign Application Priority Data

Jul. 5, 2001 (EP) ..... 01116330

(51) Int. Cl.[7] ..... B32B 31/00

(52) U.S. Cl. ..... 156/577; 156/523; 156/579; 118/76; 118/257; 242/160.4; 242/171; 242/588.6

(58) Field of Search ..... 156/523, 577, 156/579, 574, 527, 238, 538, 540; 118/76, 200, 257; 206/411; 242/160.2, 160.4, 170, 171, 588, 588.2, 588.3, 588.6

(56) References Cited

FOREIGN PATENT DOCUMENTS

| | | |
|---|---|---|
| JP | 10181289 | 7/1998 |
| JP | 10236081 | 8/1998 |

*Primary Examiner*—Christopher A. Fiorilla
*Assistant Examiner*—Cheryl N. Hawkins
(74) *Attorney, Agent, or Firm*—Jones Day

(57) ABSTRACT

The invention relates to a hand-held device for applying a film from a backing tape onto a substrate. The device has a housing in which a supply of the backing tape and a take-up device for the backing tape are arranged, and an application member which projects from the housing. The application member has an application gib and is pivotably connected to an application base supported at the housing about a swivelling axis extending transversely to the projecting application gib. The application member has two lateral support legs arranged at a distance from the application edge and defining an abutment plane with the application edge which abuts on the substrate in the mode of operation of the hand-held device. In order to enhance the bearing characteristics of the application member, the joint is provided in the projection onto the abutment plane between the support legs and the application edge.

17 Claims, 4 Drawing Sheets

HAND-HELD DEVICE FOR APPLYING A FILM, FOR EXAMPLE, OF ADHESIVE, COVERING OR COLORED MATERIAL FROM A BACKING TAPE ONTO A SUBSTRATE

CROSS-REFERENCE TO RELATED APPLICATIONS

This application is a continuation of PCT Application No. PCT/EP02/06785, filed on Jun. 19, 2002, which claims priority to European Patent Application 01 116 330.0, filed on Jul. 5, 2001. The entire contents of these two applications is expressly incorporated herein by reference.

FIELD OF THE INVENTION

The present invention relates to a hand-held device for applying a film of material carried on a backing tape onto a substrate.

BACKGROUND OF THE INVENTION

A hand-held device of this type is described in U.S. Pat. No. 5,303,759, corresponding to European Publication EP 0 507 818 B1. This previously known hand-held device comprises an application member projecting from the housing. The application member is pivotably connected to an application base at the housing of the hand-held device by a ball joint. The application member edge at its bottom side facing the substrate in the position of use two lateral support legs spaced apart from the application, which abut on the substrate like the application edge and thereby are supposed to define a certain position of the wedge-shaped application member with respect to the substrate during the mode of operation. The joint is at the rear end of the support legs. In order to ensure a stable position of the application member during the mode of operation, it is obviously necessary to use the hand-held device in a position in which the application member abuts on a stop of the base, as is illustrated in FIGS. 1 and 3 of this printed publication. This makes it more difficult to handle the hand-held device.

Publication DE 196 05 811 C1 describes a hand-held device for transferring an adhesive film from a backing tape onto a substrate, in which the film can be applied continuously or intermittently, as illustrated in FIG. 4 of said publication. In the described hand-held device, the application member is constituted by an application shaft around which the backing tape is wound and which can be selectively blocked against rotation or released for rotation by means of a setting mechanism. In the disclosed hand-held device, the shaft is an additional component, extending between lateral joint sides of an application base associated with the housing and is located at each end between fork-like side portions forming a locating means in an appertaining locating recess. This known embodiment is complex and affords high expenditure in manufacture and assembly. Moreover, stability is impaired by the fork-like division of the joint sides.

SUMMARY OF THE INVENTION

It is an object of the invention to improve the bearing properties of the application member in a hand-held device. It is to be ensured that the application edge remains at the substrate during the mode of operation.

In the hand-held device of the present invention, a joint is provided in the projection onto the plane of abutment between the support legs and the application edge. Thereby, the application member is held on the substrate in a stable manner during operation. In the mode of operation, the application edge is permanently pressed against the substrate due to a torque which is automatically in operation permanently due to a distance directed towards the application edge, which distance is the distance of the joint axle from the support legs.

The present invention provides a hand-held device in the form of a simple and stable construction. In one embodiment of the hand-held device of the present invention, a rigid joint axle is provided which is formed at the joint sides and thus associated therewith and manufactured in one part. Thereby, a simple and inexpensive embodiment is created, which results in substantial simplifications also in view of assembly and disassembly. Furthermore, the embodiment results in a sturdy construction because the joint sides are stabilised by the joint axles integrally associated therewith. What is to be taken into consideration is that, during operation, substantial pressure is exerted on the application member and thus also on the appertaining joint, which the embodiment according to the invention can safely absorb also in case of a small construction.

In one embodiment of the present invention, the locating device is mounted between the joint sides. Thereby, the joint sides are free from locating, so that they can be designed in a more stable and simple fashion. The locating device can make favorable use of the space available between the joint sides, without impairing or increasing the construction, so that a small construction is achieved, too. Moreover, the configuration according to the invention is suitable also when it comes to simple assembly or disassembly or to the accessibility for assembly and disassembly.

Further features of the invention lead to large bearing surfaces of the joint and enable small surface pressing, improve the support of the application member relative to the base also in a lateral direction, and result in more favorable shapes as far as spatial requirements are concerned.

A further advantage of the configuration according to the invention consists in that in the event of several application members of different shapes being associated with the hand-held device, the application members can selectively be mounted to the hand-held device easily and rapidly and the hand-held device thus can be adapted to different requirements as to application.

In the following, preferred configurations of several exemplary embodiments shall be explained in more detail with the aid of drawings.

MORE DETAILED DESCRIPTION

Figure 1:
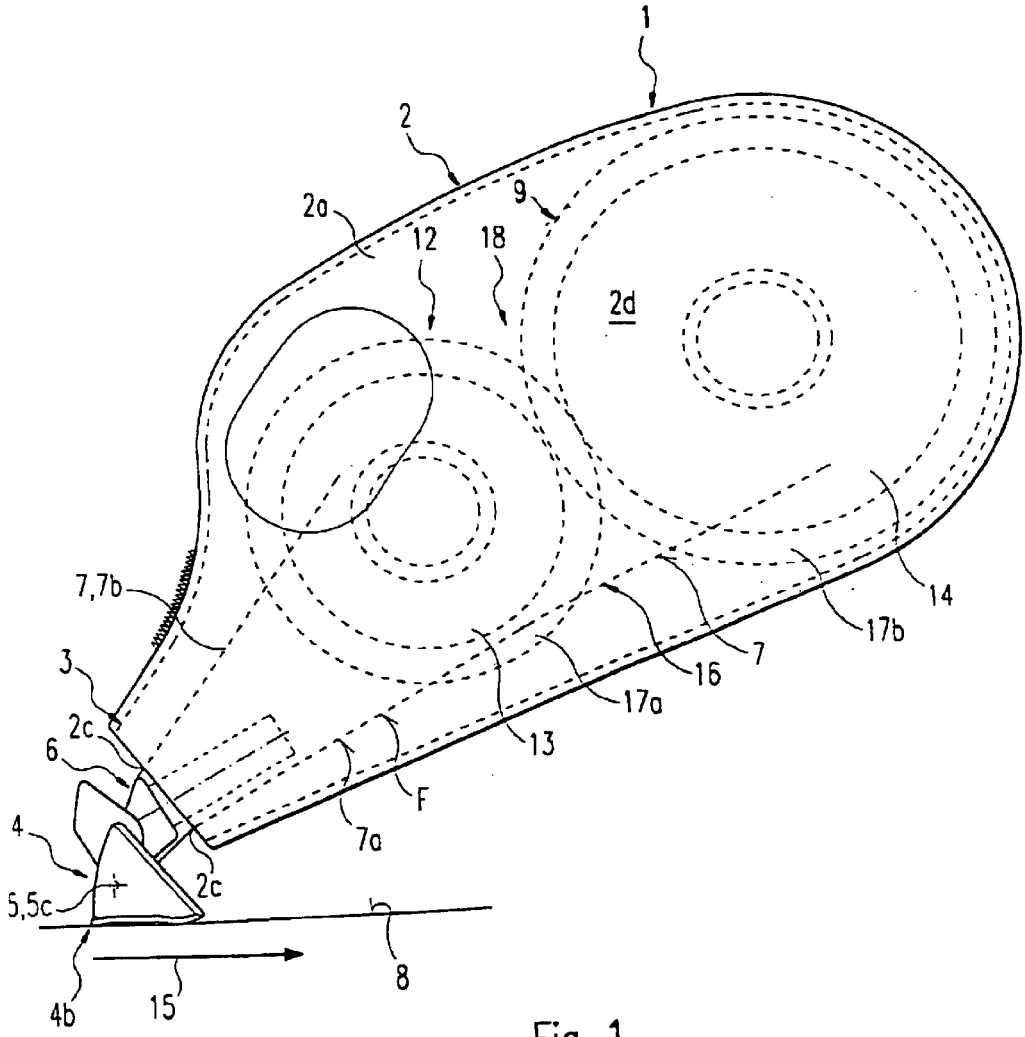
FIG. 1 is a side view of a hand-held device according to the invention for transferring and/or applying a film from a backing tape onto a substrate.

The hand-held device 1 of the present invention comprises a housing 2 of convenient size, which consists of two longitudinally or transversely divided housing parts 2*a*, 2*b* which can be mounted to each other in a detachable or non-detachable fashion. FIG. 1 shows hand-held device 1 it its position of operation. The left-hand and lower end of housing 2 or the hand-held device 1 in FIG. 1 is its working end 3 at which an application member 4 is provided, which projects from the circumference of housing 2 with an application gib 4*a*. The application gib 4*a* extends in a wedge-shaped convergent fashion towards an application edge 4*b* which is, at its free end, rounded, if necessary. The application member 4 is associated with an application base 6 by a joint 5 (which will be described further below) so as to be pivotable or tiltable to a limited extent. Application base 6 is mounted to housing 2 in a detachable fashion in the exemplary embodiment.

Hand-held device 1 serves for transferring a film F of covering and/or colored and/or adhesive material from a film-like backing tape 7 onto a substrate 8, for instance a sheet of paper. The backing tape 7 extends from a supply located in the cavity of housing 2 towards application member 4 in the area of at least one housing aperture 2*c*, is wound around application edge 4*b* of application member 4, and is refed to cavity of the housing 2 through housing aperture 2*c*. The winding plane is referenced by E1. The backing tape section approaching the application gib 4*a* at the lower longitudinal or approach side 11*a* of application member 4 is referenced by 7*a*. The backing tape section being refed into housing 2 at the upper longitudinal or return side 11*b* of application member 4 is referenced by 7*b*. The winding plane E1 extends roughly parallel to and preferably mid-centrally to the broad sides 2*d* of housing 2, which extend, for instance parallel to each other, the peripheral surface of the narrow side of housing 2 being referenced by 2*e*. The returning backing tape portion 7*b* extends towards a take-up device 12 mounted in the cavity of housing 2, wherein take-up device 12 can be a take-up spool 13 which is rotatably mounted in housing 2. Supply 9, can similarly be formed by a spool, namely a supply spool 14 which is rotatably mounted in housing 2. In the exemplary embodiment, supply 9 and take-up device 12 are arranged behind each other, take-up device 12 being disposed between supply 9 and working end 3 of housing 2.

In the position of operation according to FIG. 1, application member 4 abuts substrate 8 with its application edge 4*a*, wherein the central axis 4*c* of the application gib 4*a* encloses an acute angle W1 with the substrate 8 extending, for instance to be straight, the angle ranging, for example, between approximately 30° to 60°. By moving the hand-held device 1 in the application direction identified by reference numeral 15, the backing tape section 7*a* is peeled off supply 9 due to the friction at substrate 8. In doing so, film F remains on the substrate surface, and backing tape section 7*b* is moved into the cavity of the housing 2, here to the take-up device 12. Backing tape section 7*b* is driven by backing tape section 7*a* approaching application member 4 or its tensile force. In the present exemplary embodiment, this is effected by providing a swivel drive connection 16 between supply spool 14 and take-up spool 13, for instance in the form of overlapping rubbing surfaces 17*a*, 17*b* at the peripheral edges of the walls of the spools. The winding diameter of spools 13, 14 is dimensioned to be large enough for take-up spool 13 to attempt to pull in backing tape 7, also in the event of a full supply spool 14, at a speed which is higher than the speed at which backing tape 7 is wound off supply spool 14. By a slip friction clutch 18 integrated in the swivel drive connection 16, which here is formed by the rubbing surfaces 17*a*, 17*b* which are in frictional contact with each other, it is ensured that take-up spool 13 pulls in backing tape 7 always at a certain tensile stress, whereby the formation of loops in backing tape 7 is avoided. The application movement direction 15 is directed to the end of housing 2 opposite working end 3.

Swivel axis 5*a* of joint 5 extends parallel to application edge 4*b*. Consequently, application member 4 is pivotable to a limited extent in joint 5 in winding plane E1.

The joint 5 between application base 6 and application member 4 is formed by at least one joint recess 5*a* at the one joint member and at least one joint axle 5*b* to be inserted therein transversely and mounted therein at the other joint member. In the exemplary embodiment, recess 5*a* is formed at the back of application gib 4*a* as a semicircular bearing groove extending transversely over its full length, into which bearing axle 5*b*, which also extends transversely, is inserted from behind and is located by a locating device 9 so as to be preferably releasable. The joint axle 5*b* is formed integrally with joint webs 21, which can extend forwards, for instance, from the front end of a supporting gib 22 of application base 6 in its extension and can have a rectangular shape, joint axle 5*b* being preferably provided in the lower corner area of joint webs 21. As a result of the integral configuration of the joint axle 5*b* with joint webs 21 and supporting gib 22 of application base 6, this arrangement is stabilized. Supporting gib 22 has a preferably planar bottom side 23 and an upper side 24 which is also preferably planar, the bottom and upper sides limiting the wedge-like shape of supporting gib 22 and thus limiting an acute angle W2, which is open to the back and can range, e.g., between about 30° and 45°.

The locating device 9 is constituted by one or two locating arms 9*a*, 9*b* facing each other and being provided at the upper and/or lower border of joint recess 5*a*, engaging behind the joint axle 5*b* and being resiliently bendable so that joint recess 5*a* of the at least one locating arm 9*a* evades resiliently when joint axle 5*b* is inserted and is spring-mounted behind joint axle 5*b*, whereby said locating arm 9*a* is retained in joint recess 5*a* in a form-fit fashion. In the exemplary embodiment, the at least one locating arm 9*a* extends backwards from the lower and/or upper border of joint recess 5*a* in a curved manner into a position engaging behind joint axle 5*b*, preferably in a curved manner. Between the free end of the at least one locating arm 9*a* and the other border of the joint recess 5*a* or the end of the second opposite locating arm 9*a*, an insertion slot 15 for the joint axle 5*b* is present, in particular with rounded or inclined insertion surfaces 16 provided at the end(s) of locating arm(s) 9*a*. Insertion surfaces 16 cause automatic removal of the locating arm(s) 9*a* from the spring-mounted position when the joint axle 5*b* is inserted. The free d(s) of the locating arm(s) 9*a* extend(s) into a space 17 available between joint axle 5*b* and the front end of supporting gib 22. The axial dimensions of locating arm(s) 9*a* is/are large enough for it/them to fit between the joint webs 21 with a certain freedom of play. As a result thereof, there are recesses 18 for joint webs 21 on both sides of the at least one locating arm 9*a*.

There are two lateral guiding webs 29 extending backwards from application gib 4*a*, which are dimensioned large enough to exceed the width of backing tape sections 7*a*, 7*b* downwards and upwards. The distance between guiding webs 29 is adapted to the width of backing tape 7 ensuring a certain freedom of play. The distance c also conforms to the width of support gib 22. What is provided at support gib 22 are lateral guiding webs 31, which exceed support gib 22 preferably only upwards and which are accepted in recesses 32 at the inner sides of guiding webs 29 ensuring freedom of play. Preferably, the step surfaces of recesses 32, enclosing for instance an obtuse angle W3, form stops 33*a*, 33*b* for guiding webs 31. In the present configuration, lateral guiding webs 31 enclose between their front side and bottom side an angle W4, which is dimensioned to be smaller than the angle W3 by the swivel area of application member 4. Recesses 32 and guiding webs 31 can extend up to swivel axis 5*c*.

Guiding webs 29 on application member 4 preferably form support legs 35, which are provided in the rear and lower portions of guiding webs 29, wherein guiding webs 29 comprise a recess 36 at the bottom between supports 35 and application edge 4*b*. This is to ensure that guiding webs 29 rest on the substrate 8 only in the area of support legs 35 and that the effectiveness of application edge 4*b* is not impaired. Due to the presence of support legs 35, the angle W1 is always constant irrespective of the degree of inclination of application base 6.

The abutment plane defined by the bottom sides of application edge 4*b* and support legs 35 is referenced as E2. With respect to plane E2, joint 5 and swivel axis 5*c* are in a transverse plane E3, which extends at right angles to plane E2 and is positioned between application edge 4*b* and support legs 35, preferably in the forward half of the distance a between application gib 4*b* and support legs 35. The resulting effective distance of joint 5 or the transverse plane E3 from the application edge 4*b* is identified by b. The application force effective at application edge 4*b* is therefore more than half as high as the vertical pressure force which is transferred from the hand of the operator to hand-held device 1 and to substrate 8 during the mode of operation. In the projection to abutment plane E3, the swivel axis 5*c* thus is within the area of the distance a, especially within the area of its front half.

The bottom sides of support legs 35 are rounded, preferably in the longitudinal direction, whereby they can slide over small steps on the substrate surface without disturbance.

Guiding webs 31 exceed the upper side of support gib 22 preferably by a measure large enough for hand-held device 1 not being applicable or being applicable only with great difficulty in the event of an improper position of operation distorted by 180°. Thereby it is prevented that hand-held device 1 is used in an improper position of operation, whereby the run of the backing tape 7 would be disturbed.

Figure 3:
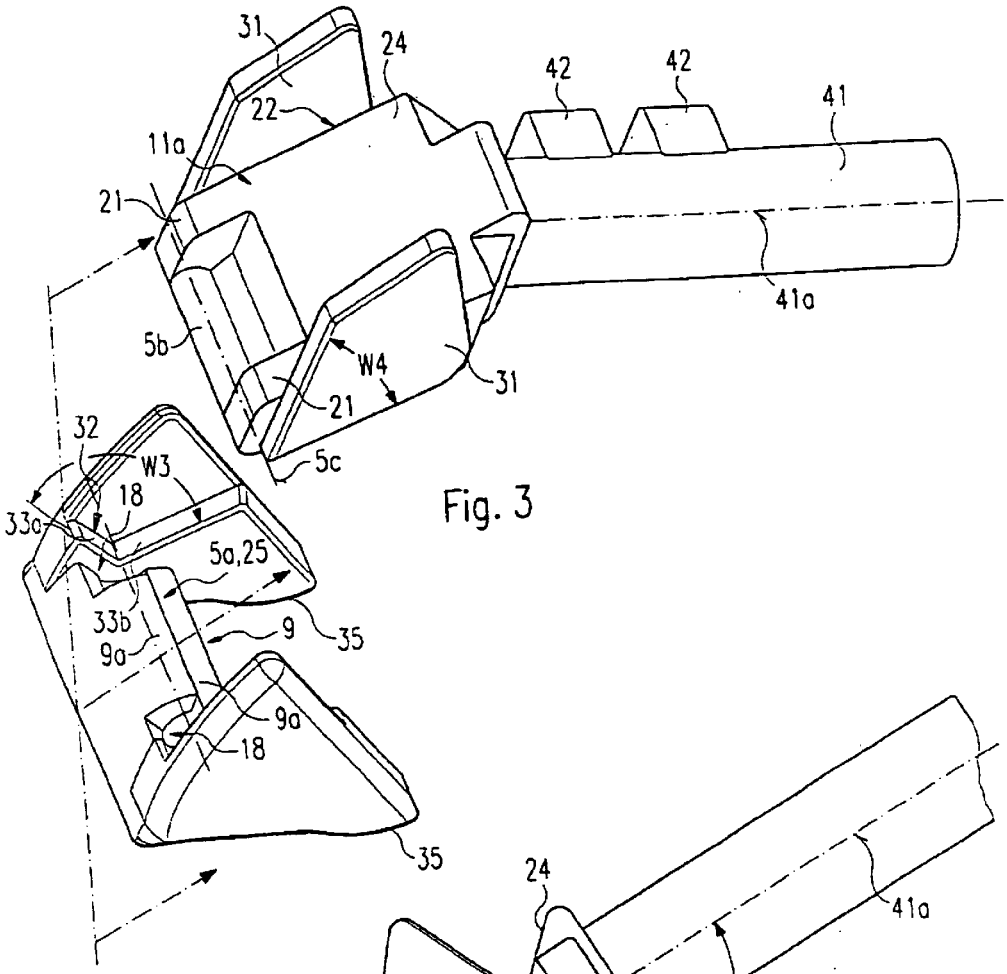
FIG. 3 is an exploded perspective view of the base and the application member in positions separate from each other.
Figure 2:
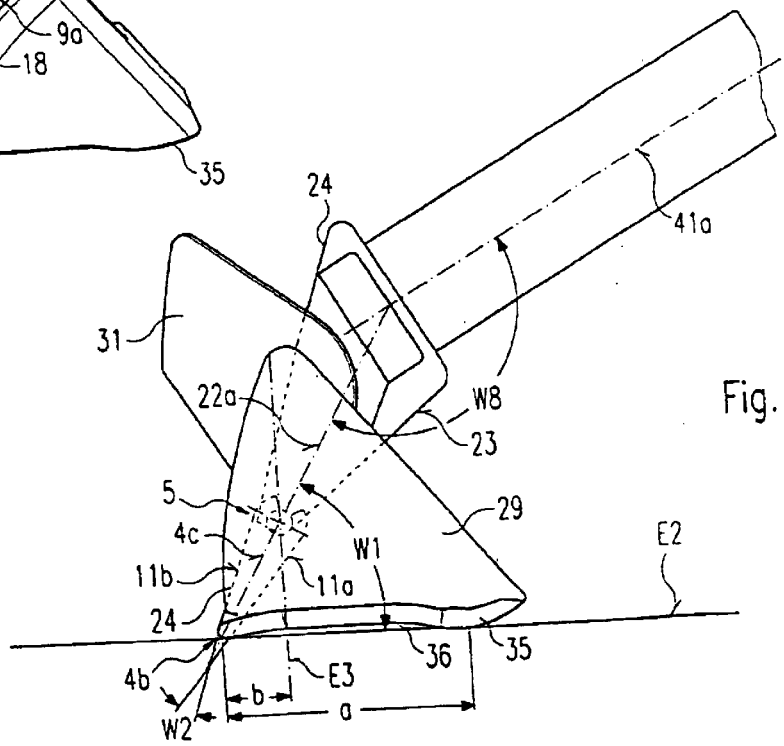
FIG. 2 is an enlarged side view of a base and an application member mounted thereto.
Figure 5:
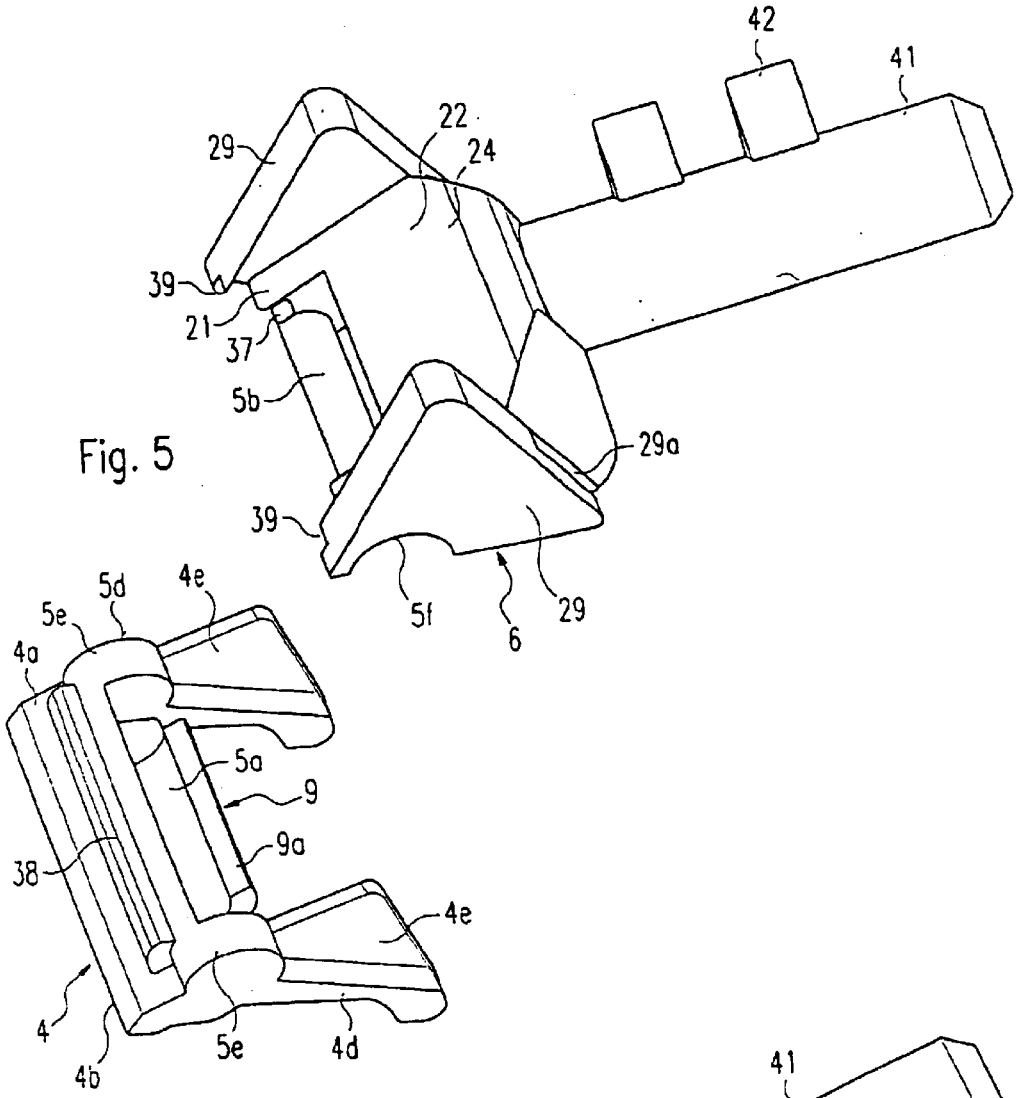
FIG. 5 is an exploded perspective view of the base and the application member according to FIG. 4 in positions separate from each other.
Figure 4:
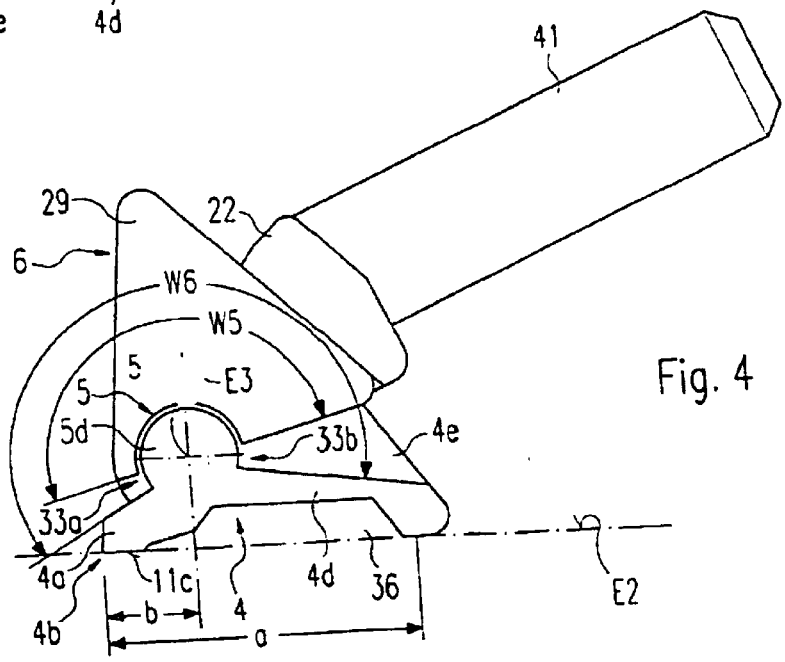
FIG. 4 is a side elevational view of the base and an application member mounted thereto in a modified configuration.

The exemplary embodiment according to FIGS. 4 and 5, in which identical or similar parts are provided with the same reference characters, is based on the exemplary embodiment according to FIGS. 2 and 3 and differs therefrom by the following features.

For one, the bearing surface of joint 5 is enlarged and laterally prolonged to the outside by a semicircular bearing bead 5*d*, which extends at the upper side of application member 4 transversely and coaxially with respect to joint recess 5*a*. Joint recess 5*a* is provided in bearing bead 5*d*, which is dimensioned to be longer than joint recess 5*b* on both sides, so that at the outside of the ends of joint recess 5*b* bearing surfaces 5*e* are present at the generated surface of bearing bead 5*d*. Application base 6 abuts bearing surfaces 5*e* with semicircular concave bearing surfaces 5*f*, which are provided at the bottom of two lateral guiding webs 29, which, in this exemplary embodiment, are the only guiding webs provided laterally at support gib 22 and can have a triangular shape.

Within the scope of the invention, bearing surfaces 5*e* and 5*f* can be provided in addition, or joint 5 can be constituted only by bearing surfaces 5*e*, 5*f*, the axle 5*b* being only a locating bolt of locating device 9.

Support legs 35 are provided at support arms 4*d* extending backwards from application gib 4*a*, wherein support arms 4*d* can be stabilised by support arm webs 4*e* extending from support arms 4*d* upwards parallel to the swivel plane. The width of support arms 4*d* can be equal in size to the width of guiding webs 29. In the exemplary embodiment, recesses 29*a* are provided inside guiding webs 29 and thus between themselves and support gib 22, into which recesses 29*a* support arm webs 4*e* immerse with the allowance of little freedom of play. Support arms 4*d* end with guiding webs 29 at the outside and therefore are positioned below guiding webs 29.

As far as the design of stops 33*a*, 33*b* limiting the swivel movement of application member 4 is concerned, there are several possibilities in this exemplary embodiment. Stops 33*a*, 33*b* can be constituted, for instance, by the bottom surfaces of guiding webs 29 present at both sides of joint 5 and enclosing an angle W5 of, e.g., about 180° and the top surfaces of support arms 4*d* and application gib 4*a*, which enclose angle W6, which is open at the top and which is larger than angle W5 by the desired pivotal angular range for the application member 4. Stop 33*b*, limiting the pitch movement to the back, can be constituted, for instance also by the bordering surfaces on the upper side of recesses 29*a*, against which support arm webs 4*e* can hit.

As far as locating device 9 is concerned, the exemplary embodiment according to FIGS. 4 and 5 provides for one locating arm 9*a* only, which extends upwards, for example, from the rear end of the joint recess 5*a*. What can be provided at application base 6 between bearing axle 5*b* and joint webs 21 is a recess 37 into which the front end of joint recess 5*a* can immerse in the appertaining swivel position.

In addition, a transverse web 38 can be integrally formed in the transition area between bearing bead 5*d* and application gib 4*a*. Lateral web 38 can serve for stabilizing application gib 4*a* and immerse, if necessary, into a recess 39 present inside at the bottom side of the guiding webs 29. Stop 33*a* can alternatively also be provided between the aforementioned components, namely in the base portion of recesses 37, 39.

Figure 6:
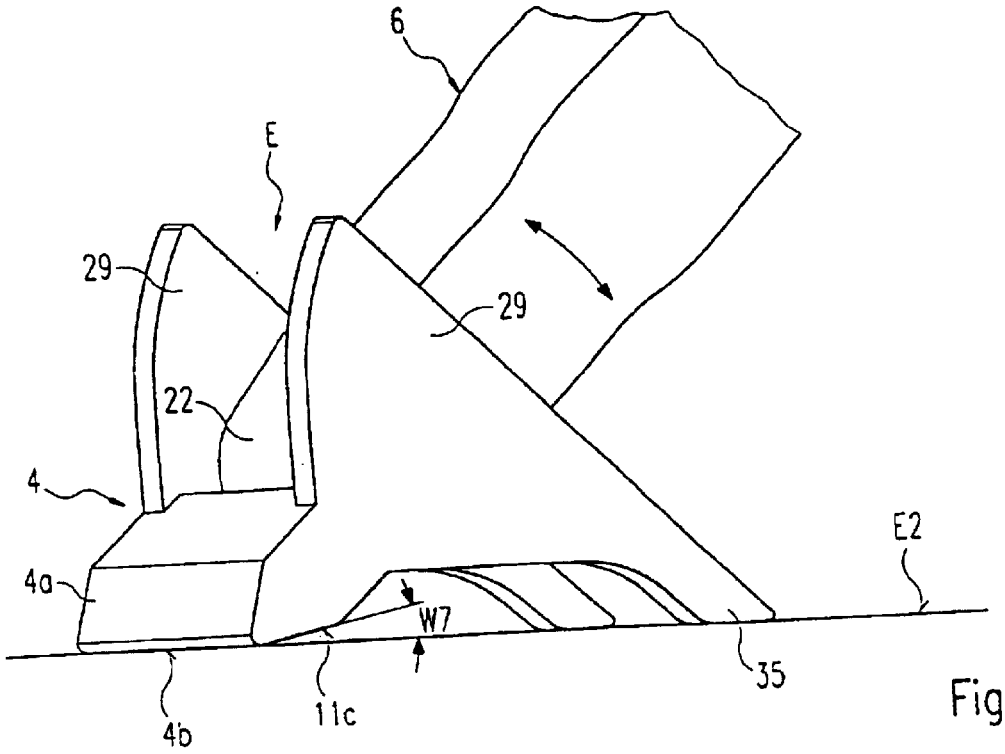
FIG. 6 is a further modified side view of a base and an application member mounted thereto.
Figure 7:
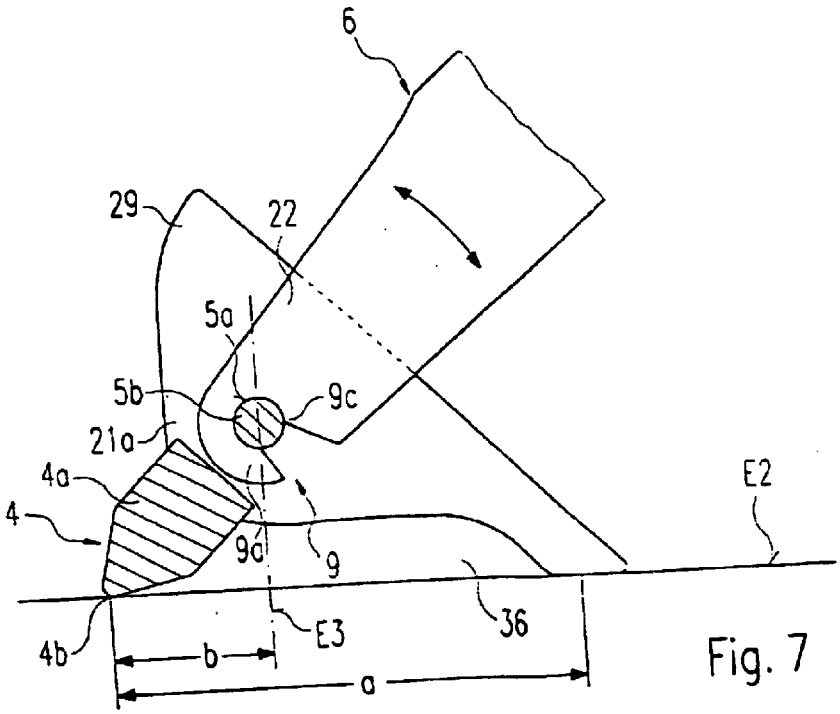
FIG. 7 is a perspective view of the base and the application member according to FIG. 6.

The exemplary embodiment according to FIGS. 6 and 7, in which identical or similar parts are also provided with the same reference characters, largely conforms to the exemplary embodiment according to FIGS. 2 and 3, in which the guiding webs 29 are formed at application gib 4*b*. According to FIGS. 6 and 7, joint axle 5*b* is formed at the inside of guiding webs 29, wherein it can extend transversely over the full length or can be constituted by two lateral axle stubs directed towards each other. Joint recess 5*a* is provided in support gib 22 and runs downwards to end at the lower longitudinal side of support gib 22. Here, too, a locating device 9 with at least one locating arm 9*a* for securing joint axle 5*b* in bearing recess 5*a* is provided. Instead of a support gib 22 extending transversely over the full length, it is possible in this exemplary embodiment to provide, as an alternative, joint webs 21 in which two correspondingly shorter joint recesses 5*a* are provided. In this configuration, guiding webs 29 constitute joint webs 21*a*, which are formed at application member 4.

In the event of only one locating arm 9*a* being provided, it is possible in all the exemplary embodiments to provide at the opposite border of joint recess 5*a* a small elevation 9*c* similar to a pressure or braking point, by which the seat of joint axle 5*b* is stabilized.

The bottom longitudinal side or approach side 11*a* of application gib 4*a* encloses an acute angle with abutment plane E2, which conforms to angle W1 or is slightly smaller. If a wedge-shaped tip is provided at the front end of application gib 4*a*, wedge surface 11*c* can lie in abutment plane E2 and form a "broadened application edge" as shown in FIG. 4, or it can enclose an acute angle W7 with abutment plane E2, which can be a free angle which can amount, for instance, to approximately 10° (FIGS. 6 and 7).

Support gib 22 can be constituted by a front end portion of a base shaft 41 of, for instance, round cross-section, which is retained in housing 2.

In all the exemplary embodiments, a lateral bearing projection 42 can be formed at the base shaft 41 to secure the base shaft 41 in housing 2. Bearing projection 42 can be limited between boundary surfaces (not represented) extending transversely and/or longitudinally with respect to central axis 41*a* of base shaft 41 at the housing 2 in the longitudinal direction and/or in the peripheral direction of base shaft 41, if necessary with a swivel play limiting a swivel movement in the peripheral direction of base shaft 41. The boundary surfaces on housing 2 can be formed by recesses which are integrally provided between formed housing walls and thus form sockets for the at least one bearing projection 42. In a housing 2 divided longitudinally, the formed housing walls are provided at the housing portion which face bearing projection 42 or two bearing projections 42 placed axially one behind the other.

The central axis 22*a* of support gib 22 can be arranged concentrically with respect to base shaft 41, cf. FIG. 6, or it can enclose an obtuse angle W8 of, for instance, approximately 120° to 165°, in particular approximately 145° to 150°, with base shaft 41.

Application base 6 and the application member 4, as well as housing parts 2*a*, 2*b* and also spools 13, 14, are preferably injection molded parts, which have preferably been made of plastic material in accurate shape and at low cost.

What is claimed is:

1. A hand-held device for applying a film from a backing tape onto a substrate, said device comprising:

a housing in which a supply of the backing tape and a take-up device for the backing tape are arranged;

an application base supported at said housing;

an application member projecting from said housing with an application gib and pivotably connected to said application base about a swivelling axis extending transversely to said application gib;

wherein:

backing tape extends through a housing aperture towards said application gib, is wound around an application edge forming the free end of said application gib and extending parallel to said swivelling axis, and extends towards said take-up device;

said application member has two lateral support legs arranged at a distance from said application edge and defining an abutment plane with said application edge; said abutment plane abutting the substrate in the mode of operation of said hand-held device; and a joint between said application member and said application base is provided in a projection onto said abutment plane between said support legs and said application edge.

2. A hand-held device as in claim 1, wherein said joint is at a distance from said application edge approximately equal to or smaller than half the distance of said support legs from said application edge.

3. A hand-held device as in claim 2, wherein said joint is at a distance from said application edge equal to approximately one third of the distance of said support legs from said application edge.

4. A hand-held device as in claim 1, wherein said joint is formed by a joint recess and a joint axle mounted therein; and said joint axle is designed to form an integral part with joint webs on one of said application member and said application base and said joint recess is formed in the other of said application member and said application base.

5. A hand-held device as in claim 1, wherein said application base and said application gib are associated with each other by a locating device.

6. A hand-held device as in claim 5, wherein said locating device is provided between joint webs on one of said application member and said application base.

7. A hand-held device as in claim 5, wherein said locating device comprises one or two locating arms facing each other, and checking said joint axle from behind.

8. A hand-held device as in claim 1, wherein said joint comprises two preferably convex bearing surfaces in the form of a cylindrical segment provided on both sides of said application gib on its top, and bearing surfaces in the form of a cylindrical segment contiguous therewith at the bottom of said application base.

9. A hand-held device as in claim 1, wherein stops bordering the swivel range of said application member are provided at said application member and at said application base.

10. A hand-held device for applying a film from a backing tape onto a substrate, said device comprising:

a housing in which a supply of the backing tape and a take-up device for the backing tape are arranged;

an application base supported at said housing;

an application member projecting from said housing with an application gib and pivotably connected to said application base about a swivelling axis extending transversely to said application gib;

wherein:

backing tape extends through a housing aperture towards said application gib, is wound around an application edge forming the free end of said application gib and extending parallel to said swivelling axis, and extends towards said take-up device;

said application member has two lateral support legs arranged at a distance from said application edge and defining an abutment plane with said application edge; said abutment plane abutting the substrate in the mode of operation of said hand-held device;

a joint between said applicator member and said application base is formed by a joint recess and a joint axle mounted therein; and said joint axle is designed to form an integral part with joint webs on one of said application member and said application base, and said joint recess is formed in the other of said application member and said application base.

11. A hand-held device as in claim 10, wherein said application base and said application gib are associated with each other by a locating device.

12. A hand-held device as in claim 11, wherein said locating device is provided between said joint webs.

13. A hand-held device as in claim 11, wherein said locating device comprises one or two locating arms facing each other, and checking said joint axle from behind.

14. A hand-held device as in claim 10, wherein:

said joint webs are designed to form an integral part with one of said application base and said application gib; and said joint recess is formed at the other of said application gib and said application base.

15. A hand-held device as in claim 14, wherein said joint recess is provided at the rear end of said application gib or at the front end of said application base.

16. A hand-held device as in claim 10, wherein said joint comprises two preferably convex bearing surfaces in the form of a cylindrical segment provided on both sides of said application gib on its top, and bearing surfaces in the form of a cylindrical segment contiguous therewith at the bottom of said application base.

17. A hand-held device as in claim 10, wherein stops bordering the swivel range of said application member are provided at said application member and at said application base.

* * * * *